US005918428A

United States Patent [19]

Hough

[11] Patent Number: 5,918,428

[45] **Date of Patent: *Jul. 6, 1999**

[54] CRACK INDUCER PLATE FOR CONCRETE

[75] Inventor: Reginald D. Hough, New York, N.Y.

[73] Assignee: Engineered Devices Corporation, Ridgefield Park, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/802,225

[22] Filed: Feb. 19, 1997

[51] Int. Cl.[6] ..... E04B 1/68

[52] U.S. Cl. ..... 52/127.3; 52/393; 52/396.05; 52/601; 52/742.14; 404/55; 404/47; 249/33

[58] Field of Search ..... 52/127.3, 600, 52/601, 396.02, 396.05, 309.14, 742.14, 704, 393; 249/33, 83, 91, 210; 404/55, 47

[56] References Cited

U.S. PATENT DOCUMENTS

| | | | |
|---|---|---|---|
| 1,233,508 | 7/1917 | Rogalske | 52/127.3 X |
| 2,167,904 | 8/1939 | Older | 404/55 |
| 2,321,813 | 6/1943 | Henzel | 52/598 X |
| 2,748,591 | 6/1956 | Brown | 52/601 X |
| 2,961,803 | 11/1960 | Shapiro et al. | 249/33 X |
| 3,596,421 | 8/1971 | Miller | 52/334 X |
| 4,132,043 | 1/1979 | Juba | 52/600 X |
| 5,033,248 | 7/1991 | Phillips | 52/742.14 |

*Primary Examiner*—Carl D. Friedman
*Assistant Examiner*—Winnie S. Yip
*Attorney, Agent, or Firm*—Notaro & Michalos P.C.

[57] ABSTRACT

A crack inducer plate assembly for concrete structures having a volume and an outer surface includes an elongated and rigid core plate for extending in the volume at a location spaced from the surface, the core plate having opposite sides. A waterproof and resilient waterstop member is fixed to and covers the opposite sides of the core plate. Cross-plates are welded to the core plate to anchor the core plate to reinforcing bars in the concrete. Cracks are formed in a controlled manner within the volume and by the waterstop member.

11 Claims, 5 Drawing Sheets

CRACK INDUCER PLATE FOR CONCRETE

FIELD AND BACKGROUND OF THE INVENTION

The present invention relates, in general, to a device and method for inducing controlled cracks in concrete to avoid unsightly cracks on the outer surface of concrete structures.

When concrete shrinks during the hydration period, stress in the concrete is relieved by cracking. The cracking is addressed in many ways depending on the conditions or use. In most structural concrete, cracking is expected and is not a problem unless the surface is subject to water intrusion, is exposed to view, or both. Then, the issue of cracking becomes paramount.

An important characteristic of architectural concrete, which is the high end of exposed concrete work, is that it have pleasing visual surfaces. When a surface is marred by unsightly cracking, or cracking which is leaching white salts, it becomes displeasing and ugly.

Cracking can be reduced through attention to the design of temperature reinforcement, optimum mix, and high quality placement and curing procedures. A wall of the same profile throughout, will crack every 10 to 16 feet or so.

In addition, cracks may appear due to isolated restraint or weakening of the wall. Restraint due to additional reinforcement, such as in-the-wall column reinforcing or intersecting wall bars, or whether the volume of the wall is reduced by openings or offsets in thickness, may also cause cracks.

There are very specific and positive ways of planning and executing concrete work relating to crack control. since cracking is a natural part of a concrete surface, it is desirable to control it so that the cracks occur in a location where they are acceptable to the appearance and also so that they can be sealed against moisture.

Unfortunately, the method most often used to address cracks in both design and construction is to ignore them. Since cracking is inevitable, it is easy to dismiss the issue and hope that the cracking will not deter from the appearance or allow moisture to enter the structure.

Ignoring cracking in exposed concrete work may suffice for a time. However, cracks will start to show. The inevitable signs of streaking where weather darkens the cracks, where white salts are brought to the surface or by leakage when water penetrates into the interior of a building, soon appear.

Allowing cracking to appear without any control is only effective when the concrete surface is heavily textured and is not exposed to weather. In this case, the texture is such a dominant feature that the cracks do not detract from the appearance and, of course, there is no water to affect the surface.

SUMMARY OF THE INVENTION

Cracking can be controlled by creating a vertical weakened section in the wall about every 10 to 16 feet. This allows the shrinkage stresses to be received at the weakened joints, inducing a crack and controlling where the crack occurs.

Construction joints are crack control joints. However, to require them at such short intervals is not practical for effective constriction except in very limited circumstances. The most effective methods of inducing cracks are through reveals on the surface of the concrete or through the introduction of crack inducer plates cast inside the concrete, according to the present invention.

Where the design of the surface calls for reveals, the designer should establish a module which is as repetitious as possible. The spacing should occur about 10 to 16 feet apart. Both the front and back surfaces of the wall should be revealed. A good rule of thumb is to reduce the thickness of the wall by 20% using the reveal.

In the case of thick walls, where the reveals on the surfaces are not enough to induce cracking or where design of the surface requires flush joints, in-the-wall-crack-inducer plates of the invention should be used. These plates are set and fastened to the reinforcing steel bars and are provided with a bond breaking material.

The plates create a weakened vertical strip inside the concrete acting to reduce the thickness similar to the use of reveals. The plates can also be encapsulated with a waterstop which not only acts as a bond breaking device but also prevents moisture penetration.

In locations where the surface design calls for flush, butt form joints, the water stopped crack inducer can be installed in line with the form joint and the crack will occur close to the joint line on the concrete surface. The crack, being generally in the same location as the form joint line, will visually relate to the joint pattern and not detract from the architectural intent as it would if it occurred at random and as an irregular line.

In addition to using reveals or crack inducer plates, cracking can further be insured, if the structural integrity allows, by interrupting up to 50% of the temperature reinforcing steel.

Crack control materials such as wood, neoprene or nylon reveals are readily available from local supply houses. The crack inducer plates of the invention are manufactured on a job-custom bases for specific use.

Accordingly, an object of the present invention is to provide a crack inducer plate assembly for a concrete structure having a volume and an outer surface, the assembly comprising an elongated and rigid core plate for extending in the volume at a location spaced from the surface, the core plate having opposite sides, a waterproof and resilient waterstop member engaged along the core plate, and covering at least the opposite sides of the core plate and anchor means for fixing the location of the rigid core plate and waterstop member in the volume to maintain the spacing between the waterstop member and core plate, from the outer surface of the concrete structure.

A further object of the present invention is to provide a method of inducing cracks in the volume of concrete at a location spaced away from the outer surface of the concrete, by imbedding in the concrete an elongated core plate which is covered by a waterproof resilient waterstop member, in the concrete at a location spaced inwardly from the outer surface of the concrete.

A further object of the present invention is to provide a crack inducing plate assembly and method which is simple in design, rugged in construction and economical to manufacture while being effective to control the cracking in concrete structures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 3:
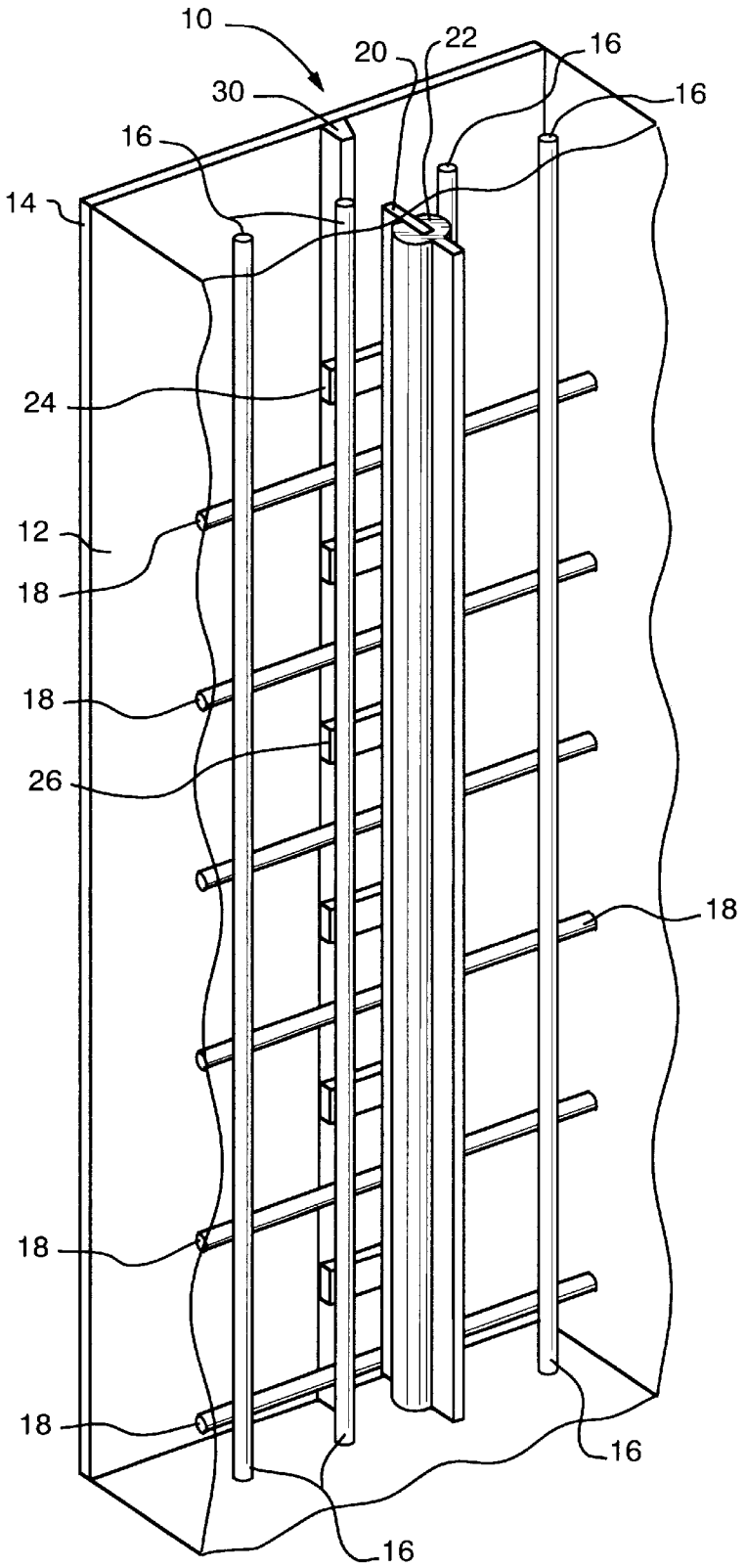
FIG. 3 is a perspective view of a section of concrete containing reinforcing rods and a plate assembly according to the present invention, the concrete being shown transparent to reveal the invention.

Referring to the drawings in particular, the invention embodied in FIG. 3 is a crack inducer plate assembly generally designated 10 which is embedded in a concrete structure 12 for inducing controlled cracking within the volume of the structure.

The concrete structure 12 is shown bounded at its outer front surface by a vertical, flat, form panel 14 which is to be removed after the concrete has set to expose the outer surface of the structure.

Also embedded within the volume of concrete is a matrix of re-enforcing bars including vertical bars 16 and horizontal bars 18 which are connected, for example by welding, at the intersections with the vertical bars 16.

Figure 1:
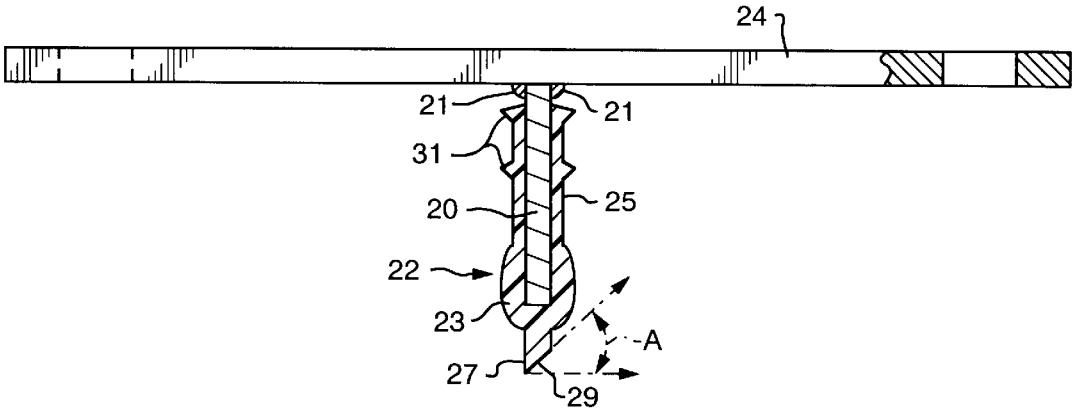
FIG. 1 is a top plan view, partly in section, of the crack inducing plate assembly according to the present invention.
Figure 2:
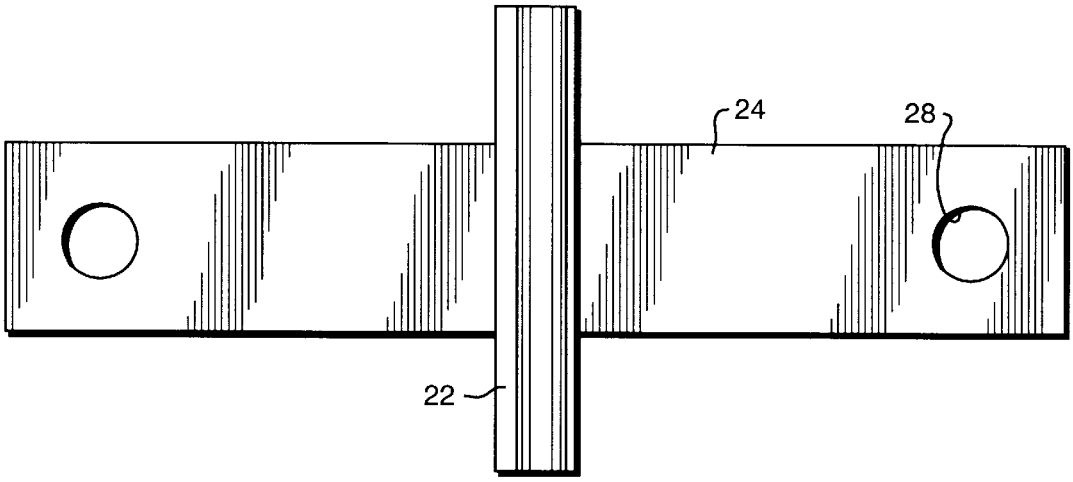
FIG. 2 is a front elevational view of a section of the crack inducer plate assembly.

The plate assembly 10 of the present invention, shown in FIG. 1 and 2 comprises a core plate 20 having opposite sides and an inner edge, which are all covered by a waterproof and resilient waterstop member 22 made for example of PVC plastic. Waterstop member 22 is fixed to core plate 20 for example by using silicone adhesive or other waterproof sealant or adhesive.

Figure 4:
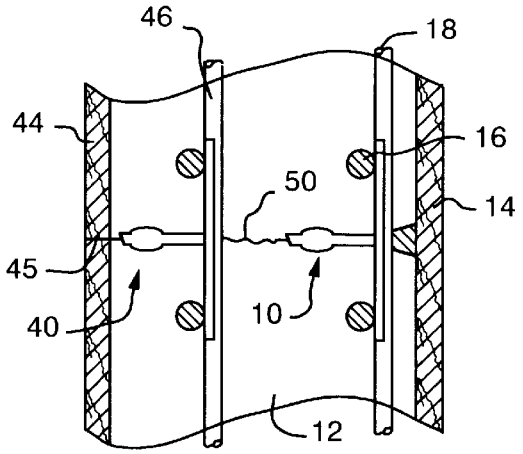
FIG. 4 is a top sectional view of a portion of concrete wall containing the present invention.

Anchor means for the purpose of setting and maintaining a spacing between the outer surface of the concrete structure 12, and the waterstop member 22, may be in the form of multiple crossplates 24 which are welded to the base of core plate 20, at spaced locations along the core plate. Crossplates 24 are attached, for example, with straps, welds, bolts or any other known mechanism, to the vertical reinforcing bars 16 as shown in FIGS. 3 and 4.

As shown in FIG. 3, the waterstop 22 of the present invention can be placed adjacent a conventional reveal member 30 which is fixed to an inner surface of the form panel 14, for producing a groove in the outer surface of the concrete structure.

The resiliency and waterproof nature of the waterstop member of the present invention controls the formation of a crack within the volume of the concrete, reducing the likelihood that the crack will reach the outer surface, or if it does, controlling the location and shape of the crack to be straight (width±¼").

As shown in FIGS. 1 and 2, preferred embodiments of the assembly include cross-plates 24 which have a pair of centered ⅜" diameter holes 28 about, ½" from their opposite ends. Although not critical, each crossplate may be made of stock metal plate material which is 1" wide and 3/16" thick.

The core plate 20 may be ⅛" thick metal stock which is 1" high and welded at its base 21 to the center of the crossplate 24.

Each crossplate 24 may be 3" long or any other appropriate length so that it can be anchored to the reinforcing structure or some other fixed structured within the volume of the concrete. Bolts, straps or other attachments pass through holes 28 to connect to bars in the concrete volume, for example.

The waterproof resilient waterstop member 22 is U-shaped so that it embraces the outer edge and opposite sides of the core plate 20. Waterstop member 22 has an enlarged end portion 23 which advantageously has an oval cross-section, and a tip blade 27 which extends beyond the enlarged portion 23 and ends at a beveled edge 29 which is beveled at an Angle A which is advantageously 45 degrees, or may be from 5 to 60 degrees from a plane that is transverse to the core plate 20. Beveled edge 29 thus forms a point at the end of blade 27 in the cross-section of FIG. 1, which forms a vertical line at the end of the blade as shown in FIG. 3. This angle helps channel water in the concrete as it sets to help control the formation of the crack within the volume of the concrete.

Waterstop member 22 also has a pair of side portions 25 which cover the opposite sides of the core plate 20 and include one or more projections 31 again for the purpose of controlling crack and waterflow, and thus the crack formation.

As shown in FIG. 4, more than one crack inducer plate assembly of the present invention can be fixed within the volume of concrete structure 12, particularly if the concrete structure is thick. As shown in FIG. 4, the concrete structure 12 is formed between flat form panels 14 and 44, and may have multiple reinforcing bar matrices in the thickness of the structure.

Assembly 40 may be attached to a separate reinforcing matrix 46 which is near the opposite outer surface of the structure 12.

A butt form joint 45 can also be positioned to correspond to the placement of the assembly 40. This will induce the formation of a crack which is shown at 50 which moves plus or minus ¼" from a line defined by the assemblies 10 and 40 and extends to the outer surfaces of structure 12.

Figure 5:
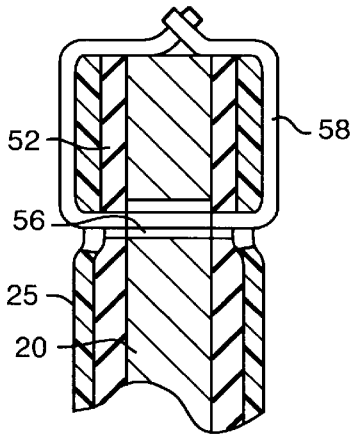
FIG. 5 is a partial sectional view of another embodiment of the invention.

As shown in FIG. 5, the opposite side portions 25 of the waterstop member 22 may be adhered to the opposite sides of the core plate 20, by adhesive such as silicone sealant or similar resilient waterproof adhesive and sealant material 52. A hole 56 may also be provided near the edge of the core plate 20 through which a cable tie 58 can pass to mechanically attach the inner edges of the side portions 25 to the core.

Figure 6:
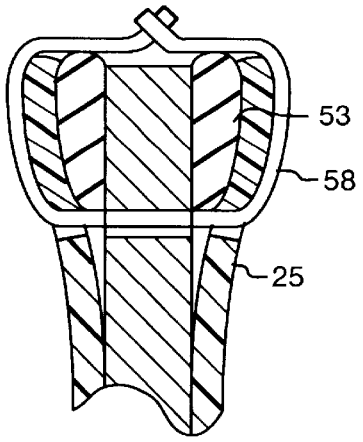
FIG. 6 is a view similar to FIG. 5 of a still further embodiment of the invention.

As shown in FIG. 6, the side portions 25 can also be made to flare outwardly by using a pair of enlarged beads or lines of silicone sealant material 53, again in conjunction with the cable ties 58.

Figure 7:
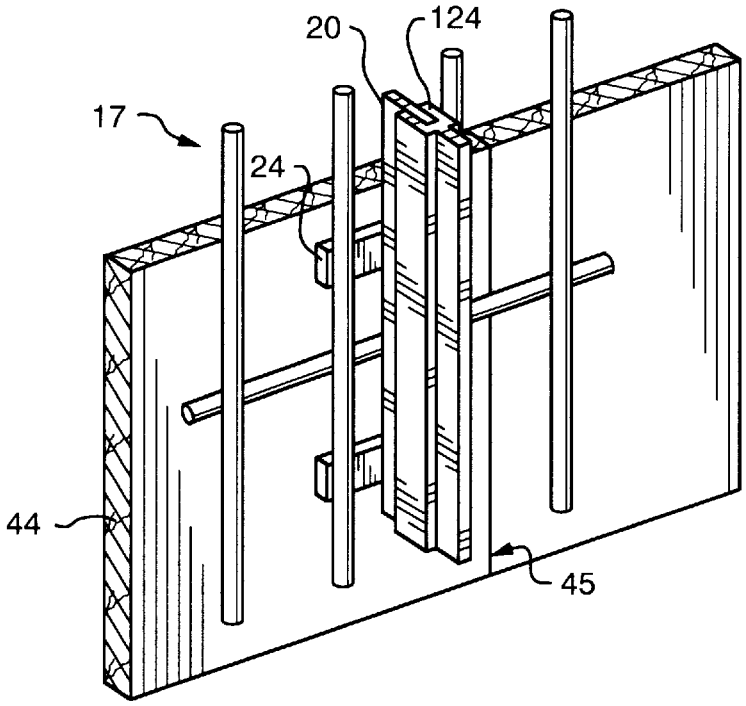
FIG. 7 is a view similar to FIG. 3 showing another embodiment of the invention in a different placement arrangement in a section of concrete.

Referring to FIG. 7, another embodiment of the invention and a different placement of the invention is shown. In FIG.

7, core plate 20 is connected to an outer layer of re-enforcing steel generally designated 17, by one or more cross plates 24. Core plate 20 is at least partly covered by a waterstop member 124 which is waterproof and resilient, for example made of PVC or other elastomer material. Unlike the waterstop 22 in the embodiment of FIG. 1, waterstop 124 has no bulbous portion. It does, however, have a blade portion which can be of the same width or of a reduced width compared to the rest of the waterstop 124 which extends beyond the core plate 20 and, in the embodiment of FIG. 7, toward a face form 44 and in alignment with and close to the form joint 45 in the form 44. Form 44 is shown transparent to reveal the placement and structure of the invention.

Figure 8:
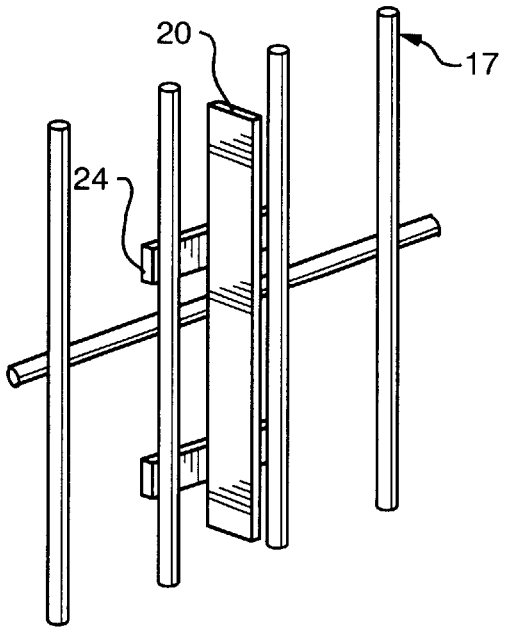
FIG. 8 is a view similar to FIG. 7 of a still further embodiment of the invention.

FIG. 8 is another embodiment of the invention where core plate 20 with its cross plates 24 is only covered by a bond break material such as sprayed-on TEFLON (a trademark for polytetraf luoroethene), a bonded fabric or some other material which at least partly covers the core plate 20.

Figure 9:
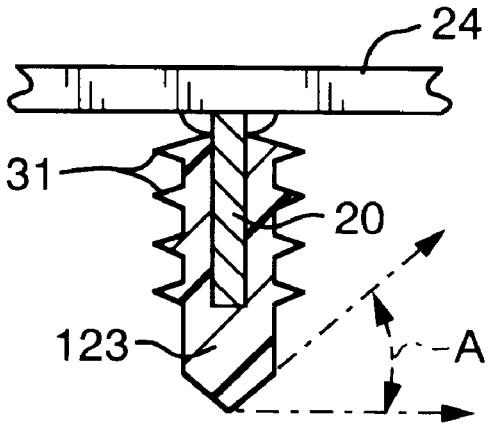
FIG. 9 is a partial view similar to FIG. 1 of another embodiment of the invention.

FIG. 9 illustrates another embodiment of the invention where the waterproof resilient waterstop member 123 covering core plate 20 has a uniform thickness with a plurality of fins or projections 31 projecting on opposite sides of the waterstop member. Waterstop member 123 also has a pointed, rather than beveled outer edge which can be pointed at angle A, for example, at an angle of about 5–60° of the plane which is transverse to the core plate 20 and on both sides of the edge to produce the point.

Figure 10:
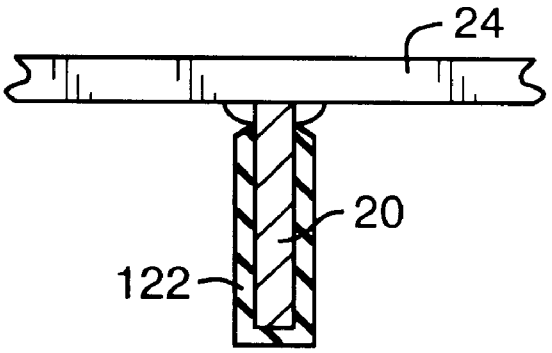
FIG. 10 is a view similar to FIG. 9 of a still further embodiment of the invention.

FIG. 10 illustrates the core plate 20, with its bond breaking layer 122 of different material such as elastomer, bonded fabric or other bond breaking material.

While specific embodiments of the invention have been shown and described in detail to illustrate the application of the principles of the invention, it will be understood that the invention may be embodied otherwise without departing from such principles.

What is claimed is:

1. A crack inducer plate assembly in combination with a concrete structure having a volume and an outer surface, and a plurality of reinforcing bars arranged within said volume, the assembly comprising:

an elongated and rigid core plate extending in the volume at a location spaced from the outer surface, the core plate having opposite sides, a front edge facing toward and being spaced from the outer surface of the concrete structure, and a rear edge facing away from the outer surface;

bond breaking means engaged along the core plate, the bond breaking means comprising a resilient waterstop member which extends around the front edge and the opposite sides of the core plate and is U-shaped, the waterstop member including a solid resilient material blade that extends beyond the core plate and the blade having a point in cross-section for forming a vertical line along the blade from which cracks in the concrete and between the front edge of the core plate and the outer surface of the concrete structure are focused;

anchor means for fixing the location of the rigid core plate in the volume to maintain a spacing between the vertical line and the outer surface of the concrete structure so that cracks are formed only in that spacing, the anchor means being a plurality of cross-plates located within said volume and being fixed to and spaced vertically along the rear edge of the core plate with, and having means for attaching the cross-plates to said reinforcing bars in said volume of the concrete structure; and said reinforcing bars, in the volume of the concrete structure being behind the rear edge of the core plate, and being adjacent to the cross-plates so there is no reinforcing bars between the front edge of the core plate and the outer surface of the concrete structure.

2. An assembly according to claim 1 wherein the anchor means comprise said plurality of cross plates fixed to the core plate and extending outwardly from opposite sides of the core plate.

3. An assembly according to claim 1 wherein the blade has a beveled edge.

4. An assembly according to claim 1 wherein the blade has an edge beveled or pointed at from about 5 to 60 degrees from a plane transverse to the core plate.

5. An assembly according to claim 1 wherein the waterstop member is a resilient waterproof waterstop member, the assembly including waterproof adhesive means between the waterstop member and the core plate for fixing the waterstop member to the core plate.

6. An assembly according to claim 5 including at least one mechanical tie connecting the waterstop member to the core plate.

7. An assembly according to claim 5 wherein the adhesive means comprises a pair of lines of adhesive on opposite sides of the core plate for flaring side portions of the waterstop member outwardly from the core plate.

8. An assembly according to claim 1 wherein the cross plates are welded to the core plate.

9. An assembly according to claim 1 including outward projections on opposite sides of the waterstop member.

10. An assembly according to claim 9 wherein the point in the cross-section of the waterstop member is formed by a bevel at an angle of about 5 to 60 degrees in an outer side of the blade.

11. An assembly according to claim 9 wherein the point in the cross-section is formed by two bevels each at an angle of about 5 to 60 degrees from a plane transverse to the core plate.

* * * * *